US007762545B2

(12) United States Patent
Kurokawa

(10) Patent No.: US 7,762,545 B2
(45) Date of Patent: Jul. 27, 2010

(54) IMAGE FORMATION APPARATUS

(75) Inventor: Yasuhiro Kurokawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 881 days.

(21) Appl. No.: 11/265,254

(22) Filed: Nov. 3, 2005

(65) Prior Publication Data

US 2007/0007713 A1 Jan. 11, 2007

(30) Foreign Application Priority Data

Jun. 27, 2005 (JP) ..... 2005-187414

(51) Int. Cl.
*B65H 3/24* (2006.01)

(52) U.S. Cl. ..... 271/127; 271/114

(58) Field of Classification Search ..... 271/162, 271/160, 114, 127
See application file for complete search history.

(56) References Cited

U.S. PATENT DOCUMENTS

| | | | | |
|---|---|---|---|---|
| 5,201,873 | A * | 4/1993 | Kikuchi et al. | 271/9.13 |
| 6,059,282 | A * | 5/2000 | Jang | 271/160 |
| 6,880,822 | B2 * | 4/2005 | Fukushima et al. | 271/157 |
| 7,111,934 | B2 * | 9/2006 | Okuda et al. | 347/104 |
| 7,270,323 | B2 * | 9/2007 | Somemiya | 271/127 |
| 2005/0189698 | A1 * | 9/2005 | Somemiya | 271/109 |

FOREIGN PATENT DOCUMENTS

| | | | |
|---|---|---|---|
| CN | 200510105284.1 | | 8/2008 |
| JP | 11-130276 | A | 5/1999 |
| JP | 11-343037 | A | 12/1999 |
| JP | 2002-154670 | A | 5/2002 |
| KR | 1999-026042 | A | 9/1997 |

OTHER PUBLICATIONS

Notification of Reasons for Refusal in counterpart Japanese Application No. 2005-187414, dated Jan. 26, 2010.

* cited by examiner

*Primary Examiner*—Kaitlin S Joerger
(74) *Attorney, Agent, or Firm*—Sughrue Mion, PLLC

(57) ABSTRACT

An image formation apparatus includes a paper supply section, a feeding section, a cam, a baseplate and an arm portion. The paper supply section is withdrawably mounted at a main body of the image formation apparatus. The feeding section is provided at the image formation apparatus main body and feeds a sheet. The cam is provided at the image formation apparatus main body and rotates in conjunction with the feeding section. The baseplate is provided at the paper supply section and is urgeable the sheet toward the feeding section. The arm portion is swingably provided at the paper supply section. When the paper supply section is installed at the image formation apparatus main body, the arm portion swings with rotation of the cam together with the feeding section and, via the resilient member, the arm portion urges the baseplate toward the feeding section.

20 Claims, 4 Drawing Sheets

0°

30°
18
16
16A
17
16B
26
24

60°

90°

300°
16D

330°
16C

360°

IMAGE FORMATION APPARATUS

CROSS-REFERENCE TO RELATED APPLICATION

This application claims priority under 35 USC 119 from Japanese Patent Application No. 2005-187414, the disclosure of which is incorporated by reference herein.

BACKGROUND OF THE INVENTION

1. Field of the Invention

The present invention relates to an image formation apparatus.

2. Description of the Related Art

Ordinarily, at an image formation apparatus such as a printer or the like, sheets at which images are to be formed are accommodated in advance at a paper supply unit, such as a cassette, a magazine or the like, which is withdrawably mounted at an apparatus main body. The sheets are taken out one at a time by a feeding mechanism provided at the apparatus main body and are fed to an image formation section, and image formation is implemented. At such a time, in order for the sheets to be taken out by the feeding mechanism with conveyance characteristics being kept constant regardless of the number of sheets remaining in the paper supply unit, a structure in which a baseplate on which the sheets have been placed is urged toward the feeding mechanism by a compression spring or the like is common. However, when sheets are to be loaded, setting of the sheets is not possible unless the baseplate is moved away from the feeding mechanism.

Accordingly, a paper conveyance unit has been proposed (see, for example, Japanese Patent Application Laid-Open (JP-A) No. 11-343037) in which, when a paper supply unit is withdrawn from an apparatus main body, in order to facilitate setting of sheets, a lift plate on which the sheets are to be placed is pushed downward, against an urging force which urges the lift plate upward, by a push-down cam. Thus, the lift plate is put into a state such that it is possible to set the paper.

However, with a paper supply unit as described above, it is necessary for the push-down cam to be pushed up by a rotary cam at times of paper supply, and there has been a problem in that a rotary load of the cams is large. Moreover, in the state when the paper supply unit has been withdrawn, the lift plate is being pushed down by the push-down cam against the urging force which urges the lift plate upward. Therefore, if, during setting of the sheets, the push-down cam is removed from the lift plate for some reason, the lift plate will rise with great vigor and there is a danger of fingers being nipped or the like. Furthermore, if the rotary cam is offset from a proper position thereof for some reason, the rotary cam and the push-down cam may collide during insertion of the paper supply unit. Hence, since there is urging by the push-down cam, if the push-down cam has been specified so as to ride up on the rotary cam, resistance when the push-down cam rides up contributes to resistance to the insertion, and it may be more difficult to mount the paper supply unit at the apparatus.

Alternatively, a paper conveyance unit has been proposed (see, for example, JP-A No. 2002-154670) which has a structure in which: a raising/lowering member pulls up two sides of a free end of a baseplate provided in a paper supply unit, by force of extension springs; the raising/lowering member is provided in a space inside a grip which is formed at an end portion of the paper supply unit; a guide is provided at a paper supply aperture of a main body of an image processing apparatus and the guide includes a guide surface which inclines gradually upward in a direction into the paper supply aperture; and in a procedure of mounting of the paper supply unit at the paper supply aperture, a raising/lowering arm is lifted up by the inclined surface of the guide, and a leaf of paper on the baseplate is pressed against a paper supply roller.

In this example, in a state in which a cassette case is withdrawn from the paper supply aperture, the raising/lowering member is disengaged from the guide, and the baseplate is maintained in a declined state by its own weight. Therefore, sheets can be set thereat with ease. In the procedure of insertion of the cassette case into the paper supply aperture, the raising/lowering member is supported at the guide surface of the guide and gradually lifted up, so that the baseplate is raised by the force of the extension springs and the paper leaf is pressed against the paper supply roller.

However, in such a paper supply unit, since the guide is a fixed guide, it is inherently not possible to move up and down the baseplate after the mounting of the paper supply unit. Furthermore, the fixed guide takes up length, so more space is required in the direction of insertion of the cassette.

SUMMARY OF THE INVENTION

In consideration of the circumstances described above, the present invention provides an image formation apparatus which employs a paper supply section which is compact and is excellent in operability and safety.

A first aspect of the present invention is an image formation apparatus including: a paper supply section, which is withdrawably mounted at a main body of the image formation apparatus; a feeding section provided at the image formation apparatus main body, which feeds a sheet to the image formation apparatus main body; a cam provided at the image formation apparatus main body, which rotates in conjunction with the feeding section; a baseplate provided at the paper supply section, which, when the paper supply section has been mounted at the image formation apparatus main body, is urgable the sheet toward the feeding section; and an arm portion swingably provided at the paper supply section, the arm portion being coupled with the baseplate via a resilient member and the arm portion abutting against the cam, wherein, when the paper supply section is mounted, the arm portion swings in accordance with rotation of the cam in conjunction with the feeding section and, via the resilient member, urges the baseplate toward the feeding section.

According to the structure described above, the baseplate descends under its own weight when the paper supply section is removed. Therefore, there will be no danger of the baseplate rising and nipping fingers or the like during setting of sheets, and safety and operability are excellent. Furthermore, it is possible to swing the baseplate after mounting of the paper supply section so that space for a fixed guide can be made smaller.

BRIEF DESCRIPTION OF THE DRAWINGS

Preferred embodiments of the present invention will be described in detail based on the following figures, wherein.

DETAILED DESCRIPTION OF THE INVENTION

Structure of Apparatus

Figure 1:
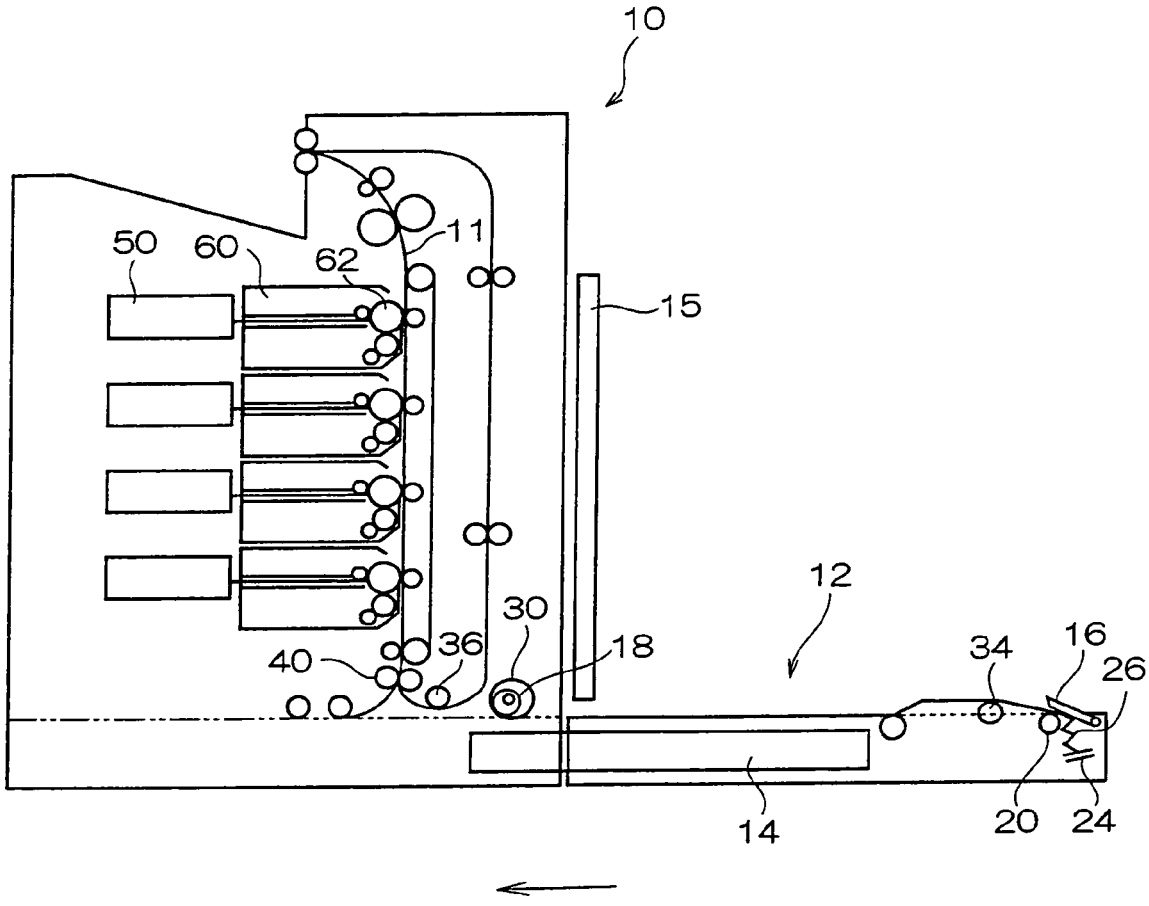
FIG. 1 is a diagram showing structure of an image formation apparatus relating to a first embodiment of the present invention.

FIG. 1 shows structure of an image formation apparatus relating to a first embodiment of the present invention.

As shown in FIG. 1, an image formation apparatus 10 is an electrophotography-type image formation apparatus which implements image exposure onto a photosensitive body 62 with an ROS 50, develops a latent image formed on the photosensitive body 62 with toner in a developing unit 60, transfers the toner onto a sheet which is being conveyed along a conveyance path 11, and fixes the toner at a fixing unit to form an image.

A sheet accommodation section 14 is provided at a cassette 12, which is mounted at the image formation apparatus 10. Sheets on which image formation is to be performed are accommodated in the sheet accommodation section 14. The cassette 12 is installed in the apparatus main body as shown by the arrow in the drawing, the sheets in the sheet accommodation section 14 are conveyed into the apparatus main body one-by-one, in order from a top sheet, and image formation processing is performed.

However, if it is desired to switch between and use plural types and/or plural sizes of sheets, if plural cassettes 12 are accommodated within the apparatus, there will be disadvantages in that the apparatus as a whole will be larger and more expensive. Accordingly, a sheet accommodation section 15 is provided at the apparatus main body separately from the sheet accommodation section 14 of the cassette 12, and it is possible to avoid the disadvantages described above when processing plural types/sizes of sheets.

That is, conveyance of plural types/sizes of sheets is enabled by formation of a sheet conveyance path separate from the sheet accommodation section 14 of the cassette 12.

Figure 2:
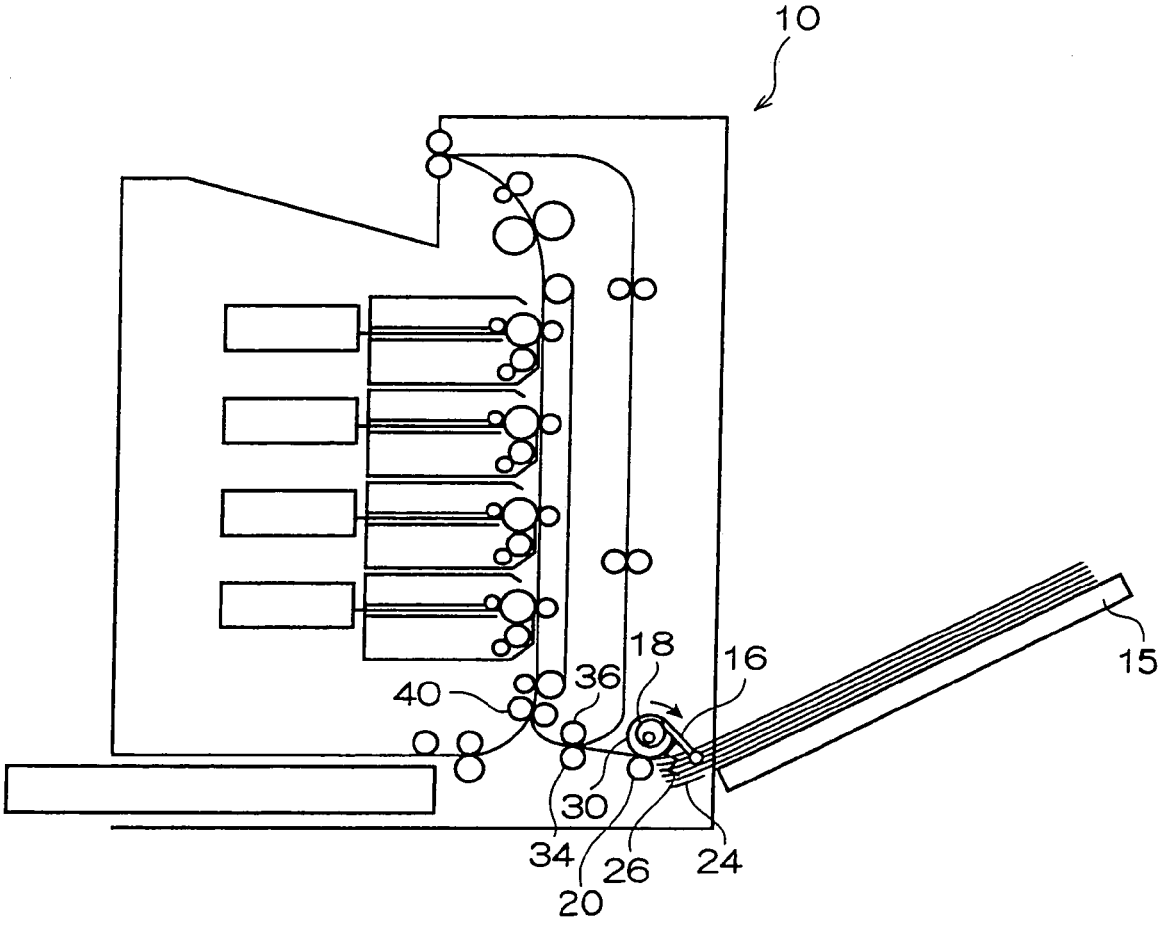
FIG. 2 is a diagram showing structure of the image formation apparatus relating to the first embodiment of the present invention.

FIG. 2 shows structure of the image formation apparatus and a conveyance section relating to the first embodiment of the present invention.

As shown in FIG. 2, the sheet accommodation section 15 is provided at the apparatus main body separately from the sheet accommodation section 14 of the cassette 12 so that it becomes possible when processing plural types/sizes of sheets to convey sheets from in front of a drawing out side of the cassette 12.

Figure 3:
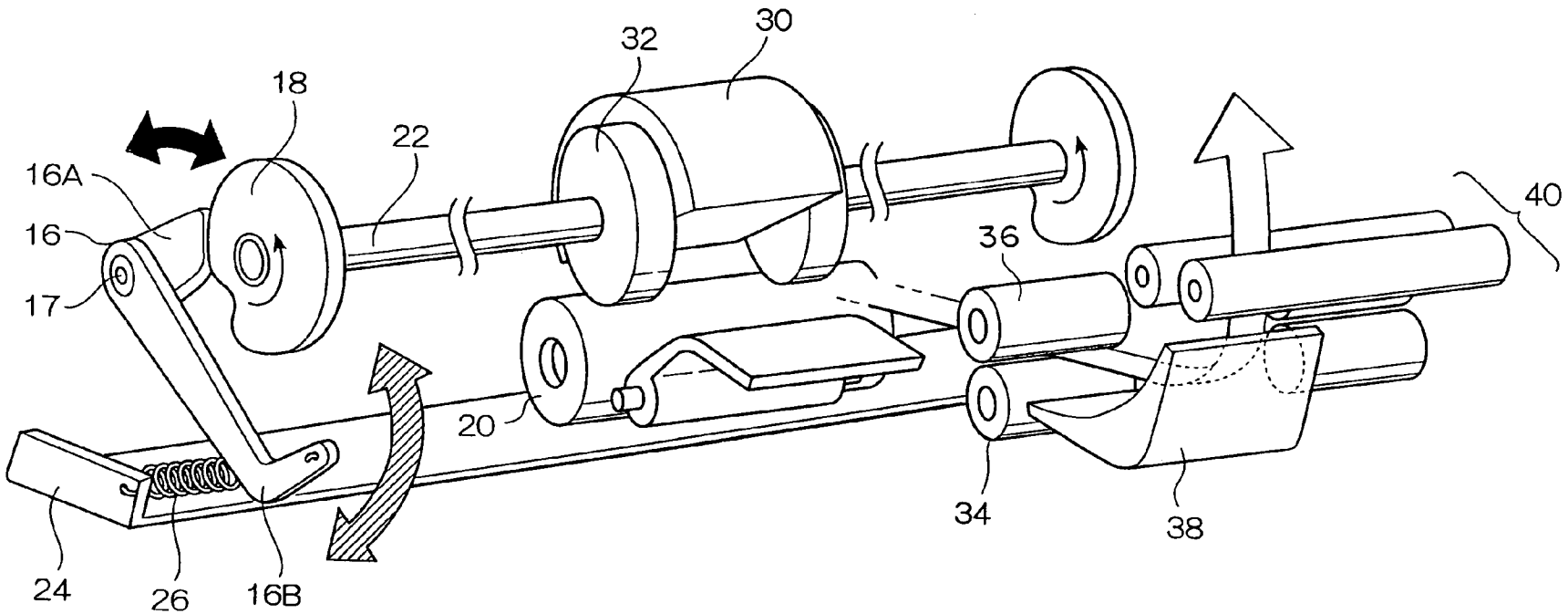
FIG. 3 is a diagram showing a paper supply section and a feeding section relating to the first embodiment of the present invention.
Figures 4A, 4B, 4C, 4D, 4E, 4F, 4G:
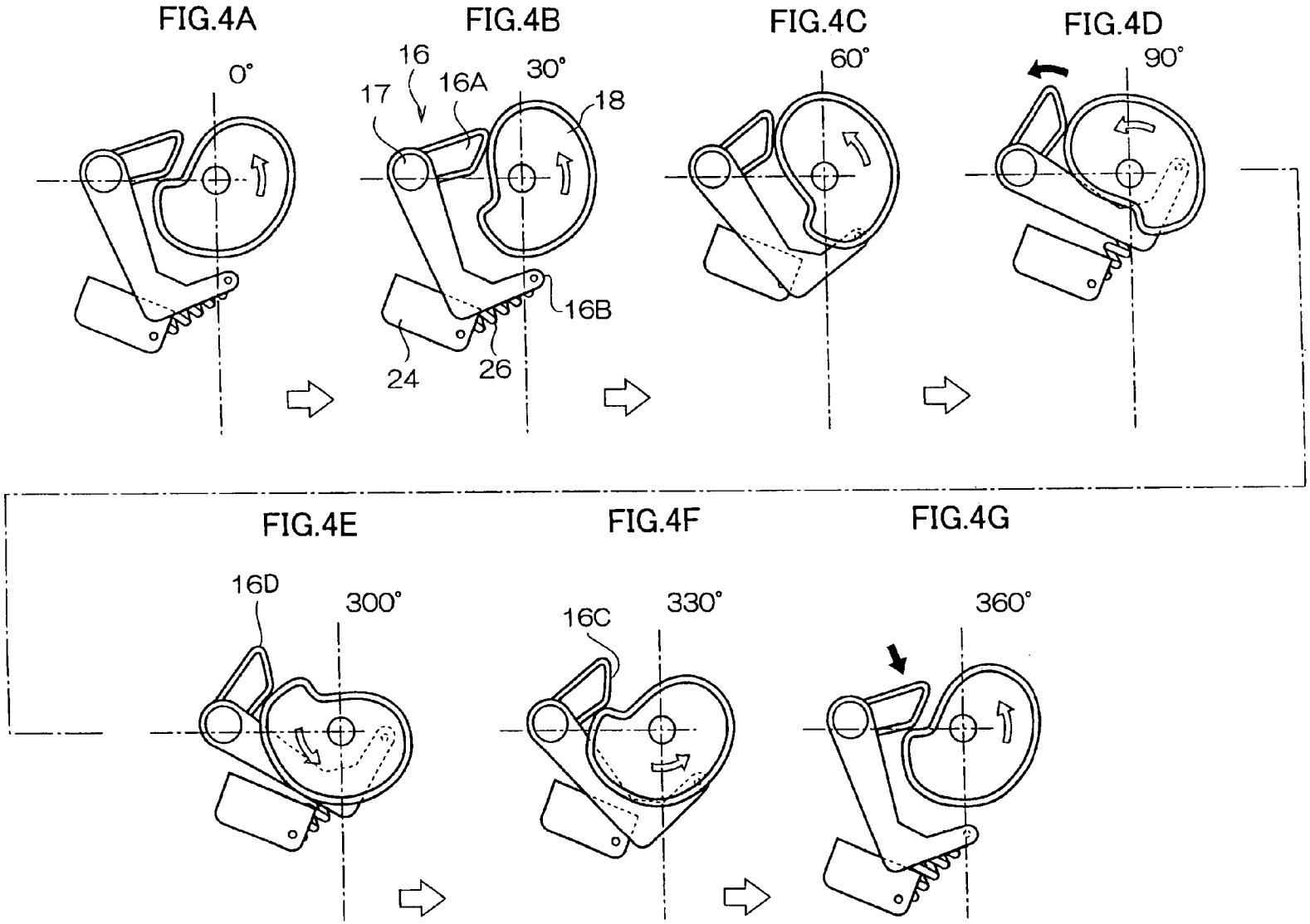
FIGS. 4A, 4B, 4C, 4D, 4E, 4F and 4G are diagrams showing a cam and a lifting lever relating to the first embodiment of the present invention.

A single topmost sheet of the inserted sheets is conveyed by a separating roller 20, and fed to the interior of the apparatus by a paper supply roller 30. The conveyed sheet is guided by guide rollers 34 and 36, abuts against a guide 38, which is shown in FIG. 3, and is guided by a pair of conveyance rollers 40.

A conveyance path subsequent to the conveyance roller pair 40 is common with the conveyance path of sheets which are conveyed from the sheet accommodation section 14. While a sheet is being conveyed along the conveyance path 11, toner images on the respective photosensitive bodies 62 for each of Y, M, C and BK are transferred to form a full-color image, then the sheet is fixed at the fixing unit and ejected.

Here, when the topmost sheet is to be conveyed from the sheet accommodation section 15 by the paper supply roller 30, in order to push a leading end of the sheets of the sheet accommodation section 15 against the paper supply roller 30, it is required to urge a baseplate 24 toward the paper supply roller 30 in synchrony with driving of the paper supply roller 30.

To be specific, a lifting lever 16 abuts against a cam 18, which is driven coaxially with the paper supply roller 30, and the lifting lever 16, via a spring 26, urges the baseplate 24 toward the paper supply roller 30.

FIG. 3 shows a conveyance section of the image formation apparatus relating to the first embodiment of the present invention.

As shown in FIG. 3, the cam 18, which is coaxial with the paper supply roller 30, that is, is provided at an axle 22 of the paper supply roller 30, rotates synchronously with the paper supply roller 30. The lifting lever 16 abutting against the cam 18 swings about a shaft 17 in accordance with the shape of an outer periphery of the cam 18. Here, the cam 18 may be provided at each of two end portions of the shaft 17, that is, at both of width direction sides of the cassette 12, or may be provided at just one side.

The lifting lever 16 is provided with two arms: an arm 16A, a distal end of which abuts against the cam 18; and an arm 16B, which drives the baseplate 24. A distal end of the arm 16B and the baseplate 24 are coupled by the spring 26. Thus, the baseplate 24 swings up and down in accordance with swinging of the arm 16B. Providing that sheets have been placed on the baseplate 24, the baseplate 24 lifts up a distal end of the sheets and urges them toward the paper supply roller 30.

The arm 16B which is coupled with the baseplate 24 by the spring 26 is longer than the arm 16A whose distal end abuts against the cam 18. Therefore, amounts of movement of the arm 16A (see the solid arrow in the drawing) are magnified in being transmitted to the arm 16B (see the shaded arrow in the drawing). Thus, it is possible to achieve a large pushing-up distance of the baseplate 24 without making the cam 18 larger. As a result, the overall apparatus can be made more compact.

When a sheet has been conveyed by driving of the paper supply roller 30, the cam 18 turns further and the lifting lever 16 returns to an initial position thereof. As a result, the baseplate 24 which is coupled with the lifting lever 16 by the spring 26 also returns to an initial position, that is, a lowest position thereof. Hence, in this initial position there is no urging of the sheets. Therefore, sheets are not conveyed at unexpected timings, and will not be fed two at a time.

When the cassette 12 is removed from the main body of the image formation apparatus, the lifting lever 16 returns to the state it was in before abutting against the cam 18, hence, the baseplate 24 returns to the initial position thereof due to its own weight (see FIG. 1). Since driving forces, complex driving mechanisms and the like are not required for this return of the baseplate 24, there will be few malfunctions, and there is no danger of the baseplate 24 rising up and nipping a finger or the like while sheets are being set.

FIGS. 4A to 4G show the cam and lifting lever relating to the first embodiment of the present invention.

As shown in FIG. 4A to 4G, of the two arms of the lifting lever 16, a distal end of the arm 16A which abuts against the cam 18 is formed as an angled surface 16C. That is, when the cam 18 turns, the angled surface 16C abuts against an outer peripheral surface of the cam 18, and the lifting lever 16 swings as shown by the solid arrows in the drawings.

As a result, the baseplate 24, which is coupled with the distal end of the arm 16B by the spring 26, urges sheets, which are not illustrated, toward a feeding roller (in an upward direction of the drawings). When feeding of a single sheet is completed (see, FIG. 4G, the drawing for 360°), the arm 16A abutting against the cam 18 swings in a downward direction of the drawings in accordance with the shape of the cam 18, and the baseplate 24 is lowered by its own weight. Thus, a sheet is conveyed without remaining sheets being urged, sheets are not conveyed at unexpected timings, and the sheets will not be fed two at a time.

Even when the arm 16A is at a lowest descended position thereof (see, FIG. 4A, the initial position at 0°), the angled surface 16C is still at a position which is higher than a center of the cam 18 (the center of the axle 22). Therefore, the angled surface 16C will not be urged downward when the cassette 12 is being inserted into the apparatus main body. Due to this structure, even if, for example, the cam 18 stops at a natural standby position thereof, which is to say a position away from the 0° (360°) position, the angled surface 16C, which is at the distal end of the arm 16A, rides up on the cam 18 when the cassette 12 is inserted into the apparatus main body. Therefore, installation of the cassette 12 is not impeded. Furthermore, because the arm 16A is not urged, resistance at the time of riding up on the cam 18 will be small.

Further, by suitable specification of the outer peripheral shape of the cam 18, it is possible to regulate timings of swinging of the baseplate with timings of driving of the paper supply roller. Specifically, it is possible to specify such that the baseplate will not be lifted up at a time at which rotation of the paper supply roller is being commenced (for example, between the 0° state and the 30° state shown in FIG. 4B), and it is possible to avoid excessive loading on a motor.

Hereabove, an embodiment of the present invention has been described. However, the present invention is not in any way limited to the embodiment described above. Obviously, various modes can be implemented within a scope not departing from the spirit of the present invention.

Specifically, in the paper supply section relating to the first embodiment of the present invention, which is provided with plural sheet accommodation sections, the sheets that are accommodated are not necessarily limited to paper and, besides an image formation apparatus, the present invention could be applied to cutting equipment, coating equipment or the like which conveys paper-like sheets.

Namely, a first aspect of the present invention is an image formation apparatus which includes: a paper supply section, which is withdrawably mounted at a main body of the image formation apparatus; a feeding section provided at the image formation apparatus main body, which feeds a sheet to the image formation apparatus main body; a cam provided at the image formation apparatus main body, which rotates in conjunction with the feeding section; a baseplate provided at the paper supply section, which, when the paper supply section has been mounted at the image formation apparatus main body, is urgeable the sheet toward the feeding section; and an arm portion swingably provided at the paper supply section, the arm portion being coupled with the baseplate via a resilient member and the arm portion abutting against the cam, wherein, when the paper supply section is mounted, the arm portion swings in accordance with rotation of the cam in conjunction with the feeding section and, via the resilient member, urges the baseplate toward the feeding section.

In the image formation apparatus of the first aspect of the present invention, the cam may be provided to be coaxial with the feeding section.

With this structure, it is possible to accurately synchronize rotation of the paper supply roller with a timing with which paper is pushed against the paper supply roller. Thus, sheet feeding performance is improved.

In the image formation apparatus of the first aspect of the present invention, the baseplate may swing after a predetermined duration from a commencement of driving of the feeding section.

With this structure, the time of maximum load on the supply roller at the start of driving can be avoided, and the swinging of the baseplate can be delayed, thereby avoiding misoperation.

Further, in the image formation apparatus of the first aspect of the present invention, the arm portion may be provided with: a first arm portion, which extends from a support point of the arm portion to the cam; and a second arm portion, which is longer than the first arm portion, extends from the support point at an angle from the first arm portion, and is coupled with the resilient member at a vicinity of a distal end of the second arm portion.

With this structure, it is possible to magnify movements of the arm abutting against the cam and transmit the movements to the baseplate. Thus, it is possible to make distances of movement of the baseplate larger without increasing size of the cam.

Further again, in the image formation apparatus of the first aspect of the present invention, an external profile of the cam may have an arc-like shape, and a face of the arm portion that abuts against the cam may be an angled face, with a distal end of the angled face consistently being at positions which are higher than a center of rotation of the cam.

With this structure, even if the cam stops at an angle which is separated from a standby position thereof, the lever can ride up on the cam, and installation of a paper supply cassette is not obstructed. Furthermore, because the lever is not urged, the lever rides up on the cam with ease and resistance to insertion of the cassette is small.

The present invention enables an image formation apparatus which employs a paper supply section which is compact and is excellent in operability and safety.

What is claimed is:

1. An image formation apparatus comprising:

a paper supply section, which is withdrawably mounted at a main body of the image formation apparatus;

a feeding section provided at the image formation apparatus main body, which feeds a sheet to the image formation apparatus main body;

a cam provided at the image formation apparatus main body, which rotates in conjunction with the feeding section;

a baseplate provided at the paper supply section, which, if the paper supply section has been mounted at the image formation apparatus main body, urges the sheet toward the feeding section; and an arm portion swingably provided at the paper supply section, the arm portion being coupled with the baseplate via a resilient member and the arm portion abutting against the cam, wherein, if the paper supply section is mounted, the arm portion swings in accordance with rotation of the cam in conjunction with the feeding section and, via the resilient member, urges the baseplate toward the feeding section; and wherein the cam is provided to be coaxial with the feeding section.

2. The image formation apparatus of claim 1, wherein the baseplate swings after a predetermined duration from a commencement of driving of the feeding section.

3. The image formation apparatus of claim 1, wherein the arm portion comprises: a first arm portion, which extends from a support point of the arm portion to the cam; and a second arm portion, which is longer than the first arm portion, extends from the support point at an angle from the first arm portion, and is coupled with the resilient member at a vicinity of a distal end of the second arm portion.

4. The image formation apparatus of claim 1, wherein the cam includes an arc-like external profile, and a face of the arm portion that abuts against the cam is an angled face, a distal end of the angled face always being at positions which are higher than a center of rotation of the cam.

5. The image formation apparatus of claim 1, further comprising a sheet accommodation section, which accommodates sheets which are to be supplied to an image formation section of the image formation apparatus main body.

6. The image formation apparatus of claim 5, wherein the sheet accommodation section is provided at an exterior portion of the image formation apparatus main body.

7. The image formation apparatus of claim 6, wherein the sheet accommodation section is rotatably provided at the exterior portion of the image formation apparatus main body.

8. The image formation apparatus of claim 5, wherein the sheet accommodation section is provided at the paper supply section.

9. The image formation apparatus of claim 1, wherein the cam and the arm portion are coupled such that, after completion of conveyance of the sheet, the baseplate returns, due to the weight thereof, to an initial position thereof, at which the baseplate does not urge another sheet toward the feeding section.

10. The image formation apparatus of claim 1 wherein, at a time of removal of the paper supply section from the image formation apparatus main body, abutting of the cam with the arm portion is disengaged and the baseplate returns, due to the weight thereof, to an initial position thereof, at which the baseplate does not urge a sheet toward the feeding section.

11. An image formation apparatus comprising:

a first paper supply section, which is withdrawably provided at an interior portion of a main body of the image formation apparatus;

a second paper supply section, which is provided at an exterior portion of the image formation apparatus main body;

a feeding section provided at the image formation apparatus main body, which feeds a sheet in the image formation apparatus main body;

a cam provided at the image formation apparatus main body, which rotates in conjunction with the feeding section;

a baseplate provided at the first paper supply section, which, if the first paper supply section has been mounted at the image formation apparatus main body, urges the sheet toward the feeding section; and an arm portion swingably provided at the first paper supply section, the arm portion being coupled with the baseplate via a resilient member and the arm portion abutting against the cam, wherein, at a time of feeding, the arm portion swings in accordance with rotation of the cam in conjunction with the feeding section and, via the resilient member, urges the baseplate toward the feeding section; and wherein the cam is provided to be coaxial with the feeding section.

12. The image formation apparatus of claim 11, wherein the baseplate swings after a predetermined duration from a commencement of driving of the feeding section.

13. The image formation apparatus of claim 11, wherein the arm portion comprises: a first arm portion, which extends from a support point of the arm portion to the cam; and a second arm portion, which is longer than the first arm portion, extends from the support point at an angle from the first arm portion, and is coupled with the resilient member at a vicinity of a distal end of the second arm portion.

14. The image formation apparatus of claim 11, wherein the cam includes an arc-like external profile, and a face of the arm portion that abuts against the cam is an angled face, a distal end of the angled face always being at positions which are higher than a center of rotation of the cam.

15. The image formation apparatus of claim 11, wherein the first paper supply section is withdrawably mounted at the image formation apparatus main body.

16. The image formation apparatus of claim 11, wherein the second paper supply section accommodates sheets which are to be supplied to an image formation section of the image formation apparatus main body.

17. The image formation apparatus of claim 11, wherein the cam and the arm portion are coupled such that, after completion of conveyance of the sheet, the baseplate returns, due to the weight thereof, to an initial position thereof, at which the baseplate does not urge another sheet toward the feeding section.

18. The image formation apparatus of claim 11 wherein, at a time of removal of the first paper supply section from the image formation apparatus main body, abutting of the cam with the arm portion is disengaged and the baseplate returns, due to the weight thereof, to an initial position thereof, at which the baseplate does not urge a sheet toward the feeding section.

19. The image formation apparatus of claim 1, wherein the arm portion comprises:

a first arm portion, which extends from a support point of the arm portion to the cam; and a second arm portion, which is longer than the first arm portion, extends from the support point at an angle from the first arm portion, and is coupled with the resilient member.

20. The image formation apparatus of claim 11, wherein the arm portion comprises:

a first arm portion, which extends from a support point of the arm portion to the cam; and a second arm portion, which is longer than the first arm portion, extends from the support point at an angle from the first arm portion, and is coupled with the resilient member.

* * * * *